US011686298B1

(12) United States Patent
Appleyard

(10) Patent No.: US 11,686,298 B1
(45) Date of Patent: Jun. 27, 2023

(54) PUMP GUARD PROTECTIVE SLEEVE

(71) Applicant: Dannon Appleyard, Shelby, AL (US)

(72) Inventor: Dannon Appleyard, Shelby, AL (US)

( * ) Notice: Subject to any disclaimer, the term of this patent is extended or adjusted under 35 U.S.C. 154(b) by 0 days.

(21) Appl. No.: 17/982,162

(22) Filed: Nov. 7, 2022

Related U.S. Application Data

(60) Provisional application No. 63/316,440, filed on Mar. 4, 2022.

(51) Int. Cl.
*F04B 53/16* (2006.01)
*F04B 23/02* (2006.01)

(52) U.S. Cl.
CPC ..... *F04B 23/021* (2013.01); *F04B 53/16* (2013.01)

(58) Field of Classification Search
CPC ..... F04B 23/021; F04B 53/16; E03F 5/025
See application file for complete search history.

(56) References Cited

U.S. PATENT DOCUMENTS 5,056,960 A * 10/1991 Marienfeld ..... B09B 1/00 405/270
5,095,737 A * 3/1992 Sharp ..... B65D 90/503 220/672
5,816,510 A * 10/1998 Earle, III ..... E03F 5/26 241/DIG. 38
5,980,155 A * 11/1999 Jones ..... B32B 15/08 405/15
6,018,914 A * 2/2000 Kamiyama ..... E03F 5/02 52/182
8,091,728 B2 * 1/2012 Burwell ..... E03F 11/00 52/169.7
2006/0002764 A1 * 1/2006 Legge ..... E02D 31/004 405/268
2011/0155672 A1 * 6/2011 McInnis ..... E03F 5/04 210/166
2017/0218587 A1 * 8/2017 Scuero ..... E02B 3/123

* cited by examiner

*Primary Examiner* — Reinaldo Sanchez-Medina
(74) *Attorney, Agent, or Firm* — Christopher R. Ganter, LLC

(57) ABSTRACT

The invention disclosed is a sump basin protective sleeve that replaces the use of common gravel as a filtering medium around sump pump basins. Disclosed is a protective sleeve having an inner layer and outer layer made of filtering microfiber whereby the inner layer and the outer layer are joined to each other whereby a geosynthetic aggregate is installed in between the inner layer and outer layer and cell pockets formed to evenly disperse the aggregate and also to provide a plurality of drain line entrances by cutting into a desired cell pocket to install a drain line without disturbing the aggregate contained in the remaining cell pockets.

15 Claims, 4 Drawing Sheets

PUMP GUARD PROTECTIVE SLEEVE

CROSS-REFERENCED TO RELATED APPLICATIONS

This application claims the benefit of priority to Provisional Application No. 63/316,440 filed on Mar. 4, 2022.

FEDERALLY SPONSORED RESEARCH

None

SEQUENCE LISTING

None

FIELD OF THE INVENTION

The present invention pertains relates to the field of improved water drainage systems in basements, crawlspaces, and other applications where water removal is required. More specifically, the present invention relates to a protective shield sleeve for sump pumps that are housed in a basin whereby the protective shield sleeve prevents debris from entering the basin and fouling and damaging the sump pump located therein.

BACKGROUND OF THE INVENTION

Sump pumps are well known in the art are used in variety of applications. For purposes of this patent application, sump pumps are widely used in a variety of configurations in basement and crawl spaces of various structures to remove water that is introduced into those spaces from locations outside of the structure. Sump pumps are also used in various applications outside of a structure. A problem encountered with sump pumps is that sediment of various sizes can enter into the sump pump and foul up and break the pump. Generally speaking, sump pumps are submersible pumping devices installed in the lowest part of a structure which are used to remove excess water (such as groundwater) from the ground near the structure to prevent flooding. Further, when water pools up in soil that is directly adjacent to a structure wall and/or basement wall, hydrostatic water pressure and extra weight builds up against the structure wall. Normally, the structure wall is adequate and built to withstand that pressure. However, with the extra weight of the water in the soil against the structure wall, hydrostatic pressure is created such that the water via gravity must travel in the direction of least resistance. The water will then often find a way under a structure wall and/or footer of the wall and enter a basement or crawlspace to which it must be then evacuated. In order to allow the excess water to reach the pumping device and then to be removed, typically sump pumps are located in a housing basin that is located in a pre-dug hole in the ground wherein said housing basin has drainage apertures that allow for pipes to be installed into said apertures and/or to allow ingress of water into the basis without the need for pipe.

One configuration, for example, is to run a configuration of drain lines in the ground around the interior perimeter of the basement whereby the drain lines terminate into the apertures of the housing basin. Traditionally, gravel is then inserted into the space between the basin and the pre-dug hole such that the gravel acts as a filter for sediment or other matter. However, over time the gravel does not prove to be effective at preventing sediment from entering the housing basin and clogging apertures located in the housing basin and further fouling the sump pump located in the basin. Further, the cost of gravel is high, its effectiveness for its intended purpose is low, and the labor it takes to lift the gravel into a tight space is time consuming and hard on a worker's body. What is need in the art is a protective sleeve that fits around a housing basin that removes the need for the use of gravel, filters sediment and other soil fines with high efficiency, and can be changed at ease should the protective shield sleeve become fouled or blocked with sediment.

SUMMARY OF THE INVENTION

The invention of this disclosure is a protective shield sleeve that is easily installable around a sump pump basin. The protective sleeve is generally cylindrical in shape although it can accommodate a rectangular basin. The sleeve has an outer layer and an inner layer and both said outer and inner layer are made of polyester micro-fiber material although other fabrics could be used. The outer layer is a rectangular strip of polyester micro-fiber that is joined to a mirror image rectangular strip which is the inner layer. The sleeve is formed by the sewing or stitching of the inner layer to the outer layer on their outside edges. Before sealing off the connection of the outer layer and inner layer, a geosynthetic aggregate is inserted into the cavity that is formed by the joining of the inner layer to the outer layer. Once the aggregate is located inside the sleeve, the opening of one end of the sleeve that the aggregate was inserted through is closed by sewing or stitching it to the opposite end of the sleeve. The aggregate is evenly distributed within the sleeve and a matrix of cell pockets are stitched into the sleeve. The cell pockets can be of a variety of shapes such as circular, square or hexagonal among others. The sleeve is insertable onto the outer surface of a sump pump basin.

DETAILED DESCRIPTION

Figure 1:
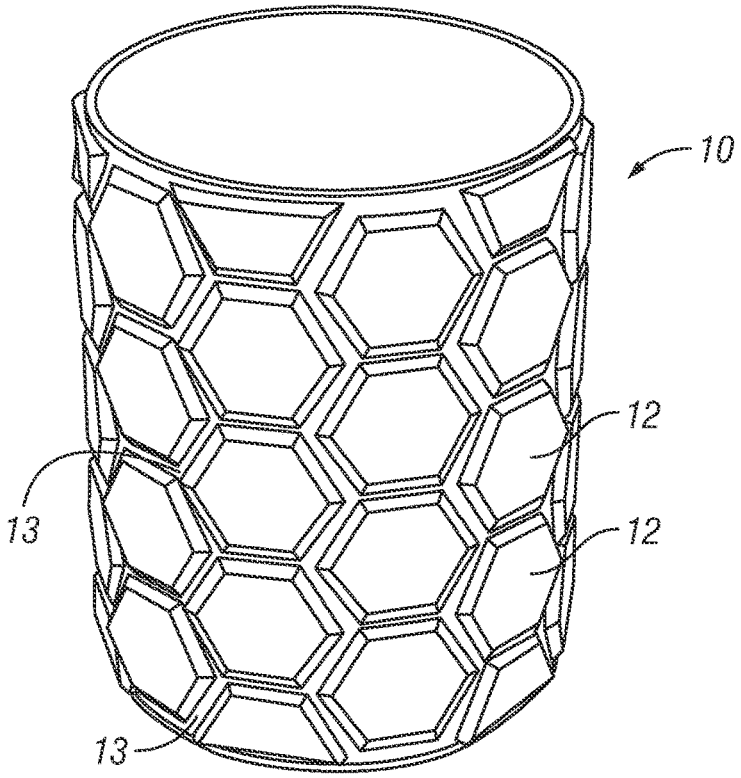
FIG. 1 is a perspective view of the sleeve.
Figure 2:
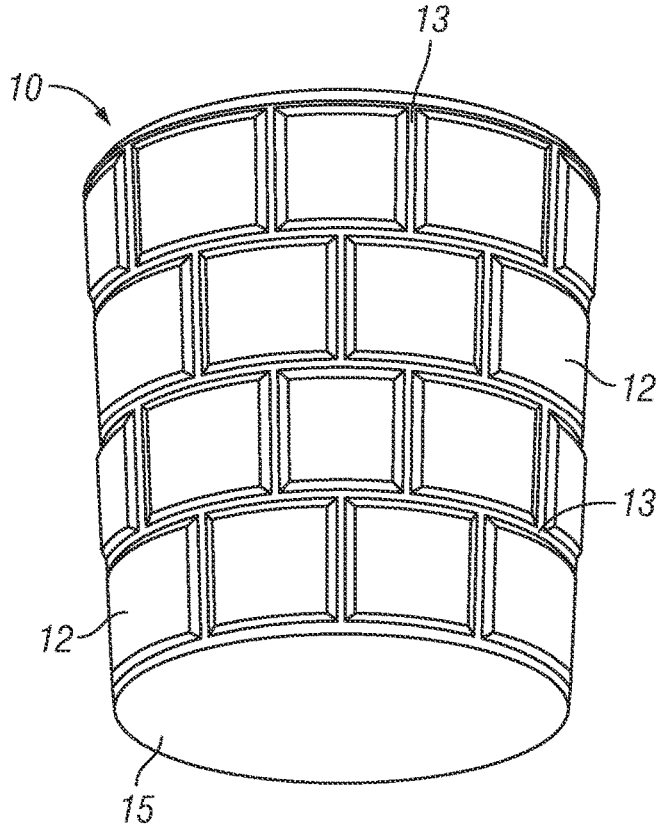
FIG. 2 is a perspective view of an alternate embodiment of the sleeve.
Figure 3:
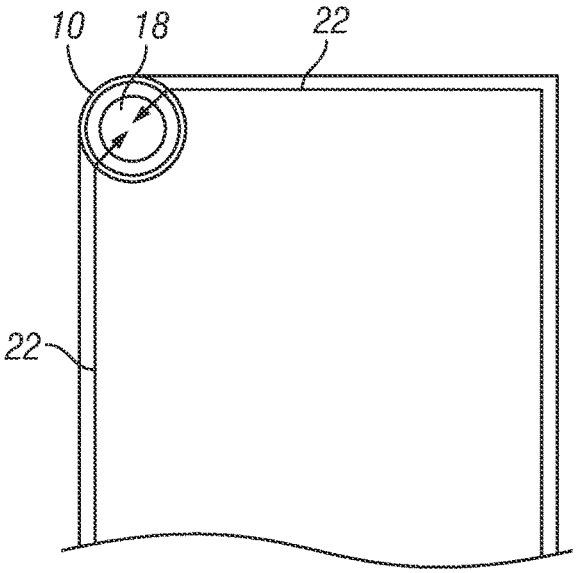
FIG. 3 is a top plan view of a sump basin located in a basement whereby the drain lines are shown leading to the sump basin.
Figure 4:
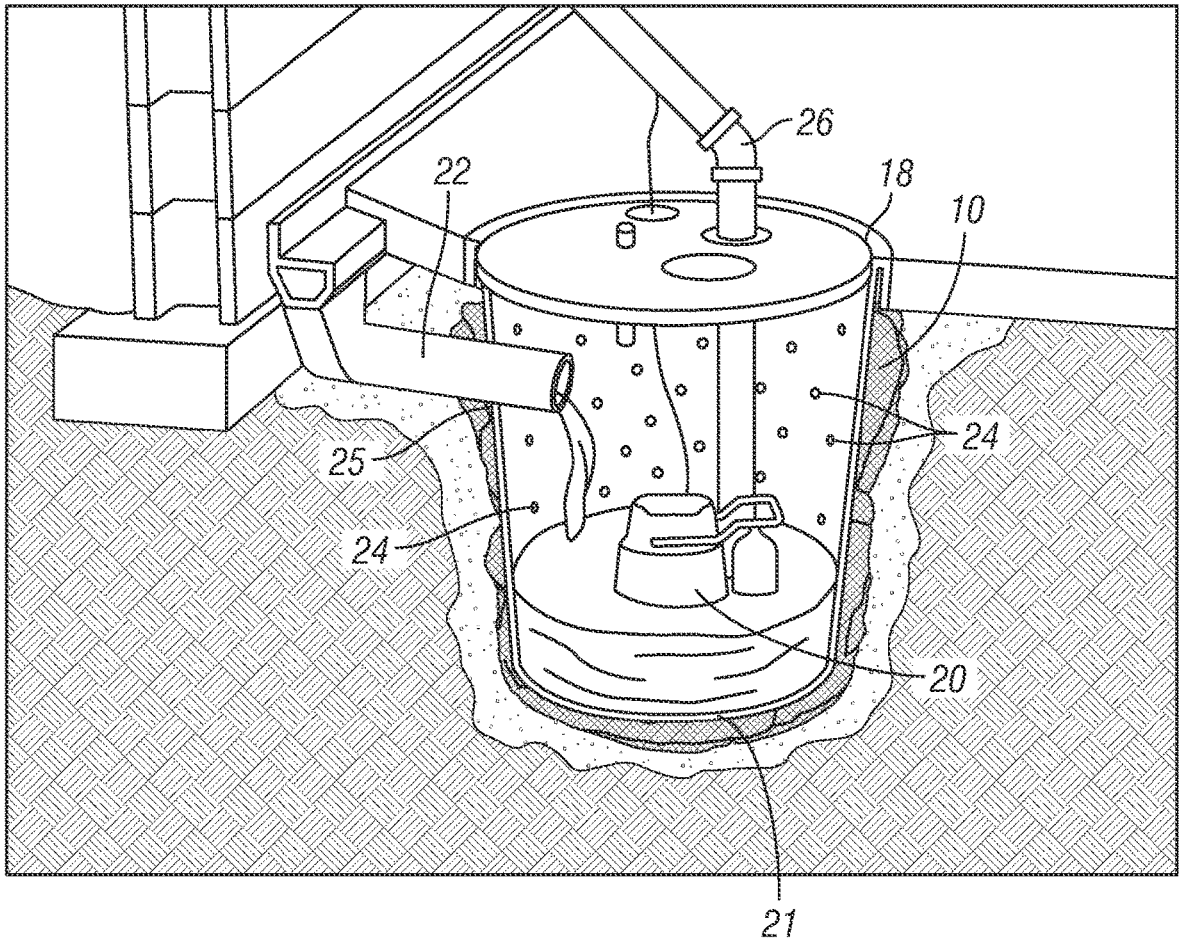
FIG. 4 is a partial cross-sectional view of a sump basin system installed in the ground of a basement and showing the sleeve around the sump basin and a drain line installed into the basin
Figure 5:
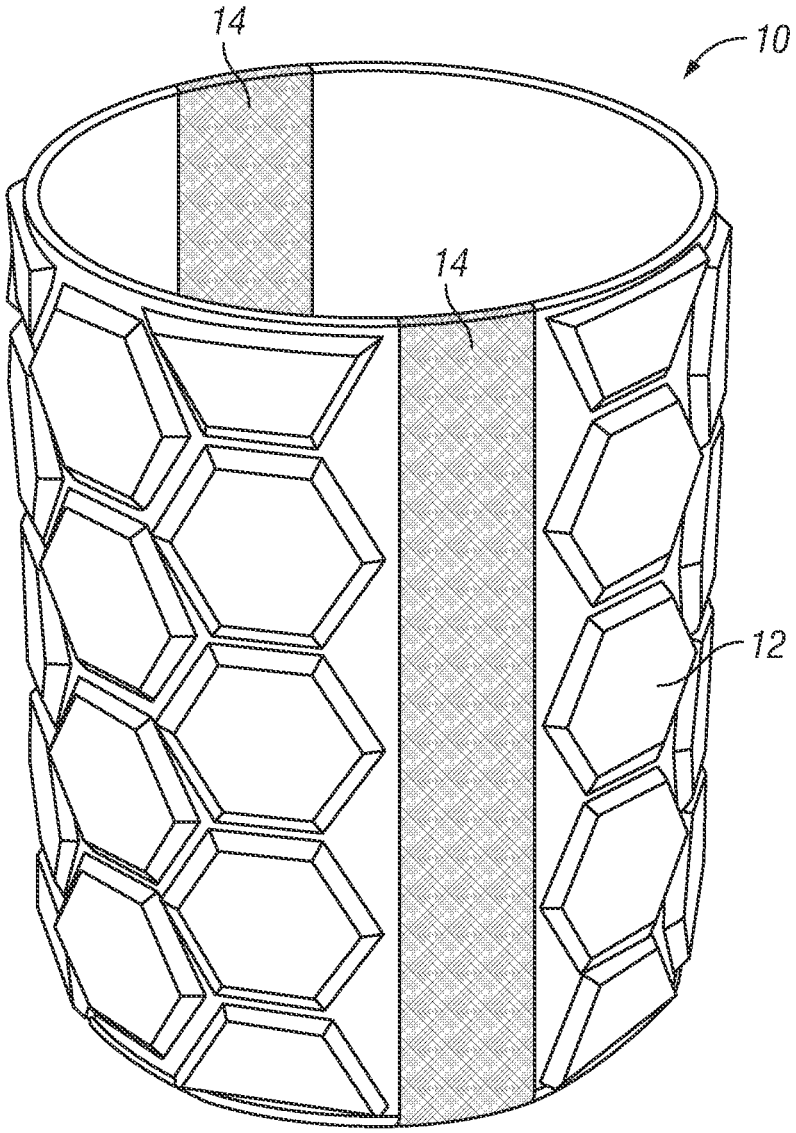
FIG. 5 is a perspective view of the sleeve showing vertical elastic panels located on the sleeve.

Referring now to FIGS. 1-6 there is shown a protective sleeve 10 having cell pockets 12 that are stitched into the protective sleeve 10. Also shown in FIG. 1 is a sump pump basin 18 that is enveloped by the protective sleeve 10. A typical sump pump system includes a sump pump 20 and a basin 18 that houses the sump pump 20. The sump pump system is usually placed in a low point of the structure in which it is being installed such as a crawl space or a basement. Many basins 18 have apertures 24 located in their sidewall 21 and also drain line apertures 25 that are intended to receive a dedicated drainage line 22 that carries water from around the perimeter of the basement or crawl space. Traditionally, sump pump basins are surrounded by various size gravels which said gravels act as a filtration system such that ground water is filtered to remove sediment and fines from the entering the basin 28 and fouling up an interior sump pump and the apertures in the basin 18. However, over time, as sediment makes its way through the gravels the apertures 24 in basin 18 become clogged with sediment and cause the sump pump to rendered ineffective. When excess water is present, such as after a hard rain, the water will work its way to the sump pump 20 via either drain lines 22 and/or the apertures 24 and the sump pump 20 will remove the water to the outside of the structure via the evacuation line 26 thus reducing or eliminating the threat of flooding.

The protective sleeve 10 is made of fabric and in one embodiment is made out of microfiber polyester that allows for the filtration of sediment out of the ground water. Particularly, a preferred fabric to be used is a geotextile mesh which is 30-sieve with apparent opening size of 0.6 mm, a unit weight between 2.5 and 3.5 ounces per square yard, and a strength of 100 pounds per square inch. The flow rate through the mesh is 300 gallons per minute per minute per foot at 3 inches of head. Other fabric materials could be used. The protective sleeve 10 can be made in a variety of sizes to accommodate various basin 18 sizes. Traditionally, basins 18 are generally circular in shape but the protective sleeve 18 could made to fit a variety of basin 18 shapes. Additionally, a simple 5 gallon bucket found in almost all hardware stores and other stores can be used by modifying the bucket by creating basin apertures 24 in the bucket and basin drain line apertures 25. The protective sleeve 10 has a bottom panel 15 and the protective sleeve is installed onto the bottom of the basin 18 and pulled upward such that it encapsulates the entire basin 18.

Figure 7:
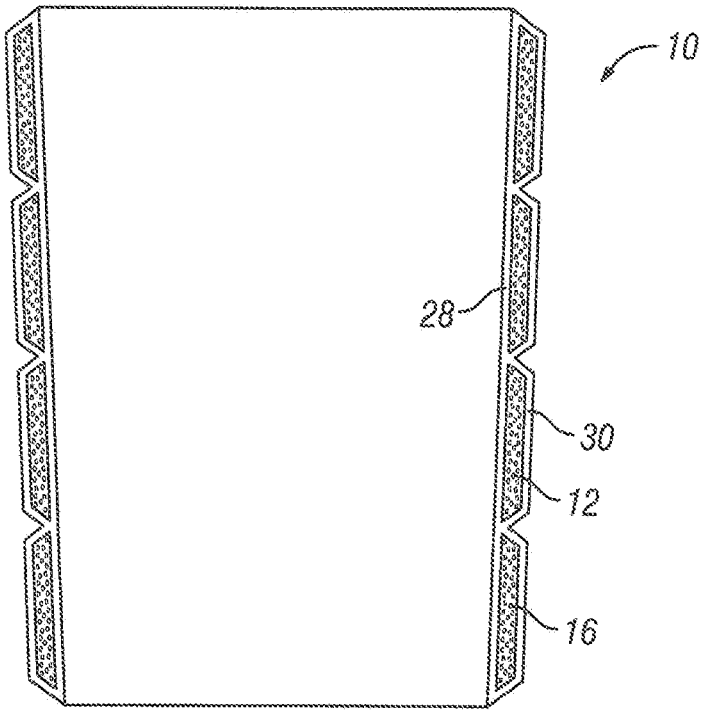
FIG. 7 is a cross-sectional view of the sleeve along the line 7-7 showing the geosynthetic aggregate located in the cell pockets of the sleeve.

Referring now to FIG. 7 the protective sleeve 10 has a fabric outer layer 30 and a fabric inner layer 28 such that said outer layer 30 corresponds dimensionally to said inner layer 28 and said outer layer 30 and inner layer 28 are joined to each other to form the protective sleeve 10 such that an interior cavity 32 is formed between the outer layer 30 and the inner layer 28. Additionally, a rectangular section of cloth can be folded over upon itself to created the outer layer 30 and inner layer 28. The outer layer 30 and inner layer 28 are joined together by sewing them together on their sides. Alternatively, an adhesive could be used to join the two layers together. Before sealing the outer layer 30 and inner layer 28 together, a geosynthetic aggregate 16 is installed into the interior cavity. The geosynthetic aggregate 16 in one embodiment is recycled or non-recycled polystyrene foam. Other lightweight materials that are synthetic could be used such that they resemble the size of gravel. The geosynthetic aggregate 16 mimics gravel but is much cheaper, lighter in weight, and easier to work with. The aggregate 16 is installed into the interior cavity 32 and evenly distributed within the protective sleeve 10. A plurality of cell pockets 12 are then formed into the protective sleeve 10 by sewing a corresponding pattern of shaped cell pockets 12 in an array. An adhesive could also be used to create the cell pockets 12. Suitable shapes could include hexagonal, circular or square cell pockets 12 into the protective sleeve 10. A desirable width of the cell pockets 12 is 4 inches but could vary according to a particular application. The sewing of the cell pockets 12 into the protective sleeve would isolate a certain amount of geosynthetic aggregate 16 into each cell pocket 12. The cell pockets 12 exist to provide even distribution of the geosynthetic aggregate 16 throughout the protective sleeve such that gravity does not cause the aggregate 16 to collect along the lower portion of the protective sleeve 10. Further, the plurality of cell pockets 12 are designed to allow an installer to cut the cell pocket 12 inside the seam of said cell pocket 12 such that a hole is opened up inside the cell pocket 12 that allows a drainage line 22 to be inserted through the protective sleeve 10 cell pocket opening and also through a basin 18 drain line aperture 25. While some of the aggregate 16 is lost out of the particular cell pocket 12 that is cut, the drainage line 22 now occupies this space in the cell pocket 12 and the remaining cell pockets 12 and aggregate 16 remain intact throughout the protective sleeve 12. Another purpose the cell pockets 12 serve is to allow an installer to have a choice of multiple locations to locate a drainage line 22 through the protective sleeve 12 and through an drain line basin aperture 25 when spatial constraints of a particular basement or crawl space dictate the placement of the basin 16 and drain lines 22.

Figure 6:
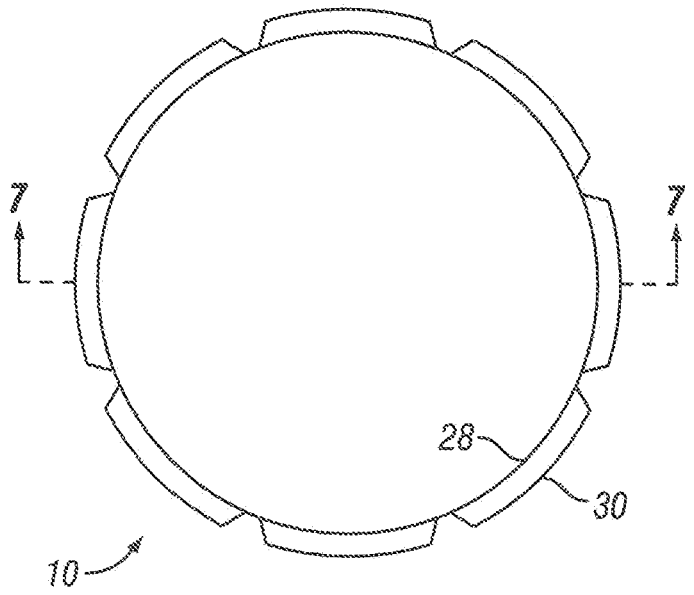
FIG. 6 is a top plan view of the protective sleeve.

Referring now to FIG. 6, there is shown a further improvement to the protective sleeve 10. Located on the protective sleeve 10 there is shown vertical elastic panels 14. In order for the protective sleeve 10 to utilize the vertical elastic panels 14 it would potentially have to be made in sections and joined together. In one embodiment, the protective sleeve 10 would be formed as discussed above, aggregate 16 installed, and cell pockets 12 formed on the surface of the protective sleeve 10. A vertical elastic panel 14 on one side would then be sewn onto one end of the protective sleeve 10 and the opposite end of the protective sleeve 10 would be sewn onto the other side of the vertical elastic panel 14. The vertical elastic panel 14 would allow a single size protective sleeve 10 to fit a number of different basin sizes. Further, a second vertical panel 14 could be integrated into the protective sleeve 10. This would require the protective sleeve 10 to be formed out of two separate pieces of protective sleeve 10 as described above whereby so as to be able to insert an opposite vertical elastic panel 14 at 180 degrees in orientation from the first vertical elastic panel 14.

The principles, embodiments, and modes of operation of the present invention have been set forth in the foregoing specification. The embodiments disclosed herein should be interpreted as illustrating the present invention and not as restricting it. The foregoing disclosure is not intended to limit the range of equivalent structure available to a person of ordinary skill in the art in any way, but rather to expand the range of equivalent structures in ways not previously contemplated. Numerous variations and changes can be made to the foregoing illustrative embodiments without departing from the scope and spirit of the present invention.

ENUMERATED ELEMENTS

10 microfiber sleeve
12 cell pockets
13 seams
14 vertical elastic panel
15 bottom
16 geosynthetic aggregate
18 basin
19 sidewall
20 sump pump
21 basin bottom
22 drainage lines
24 basin apertures
25 basin drain line aperture
26 evacuation line

28 inner layer
30 outer layer
32 interior cavity

What is claimed is:

1. A sump basin protective sleeve, comprising:

a fabric outer layer and a fabric inner layer such that said outer layer corresponds dimensionally to said inner layer and said outer layer and inner layer are joined to each other to form the protective sleeve such that an interior cavity is formed between the outer layer and the inner layer;

a geosynthetic aggregate installed into the interior cavity;

cell pockets formed along the length and width of the protective sleeve such that a portion of the geosynthetic aggregate is contained within each said cell pocket;

a junction whereby one end of the protective sleeve is joined to an opposite end of the protective sleeve such that the protective sleeve can envelop a sump basin; and a bottom panel joined to the protective sleeve.

2. The sump basin protective sleeve of claim 1 whereby the shape of the cell pockets can be hexagonal, square or circular in shape and said cell pockets can be adapted by a user to receive a drainage line.

3. The sump basin protective sleeve of claim 2 wherein the cell pockets are generally 4 inches wide.

4. The sump basin protective sleeve of claim 3 wherein there is at least one elastic vertical panel located on the protective sleeve.

5. The sump basin protective sleeve of claim 1 wherein the outer layer and the inner layer are both generally rectangular in shape and are joined to each other on three sides before the geosynthetic aggregate is introduced into the interior cavity and once the geosynthetic aggregate is introduced into the interior cavity the final side of the outer layer and inner layer are joined together.

6. The sump basin protective sleeve of claim 1 wherein the fabric is a polyester microfiber.

7. The sump basin protective sleeve of claim 1 wherein the geosynthetic aggregate is either recycled or non-recycled expanded polystyrene foam.

8. A sump basin protective sleeve, comprising:

a fabric sleeve adapted to be installed around a sump pump basin whereby said fabric sleeve has an inner layer and an outer layer;

a geosynthetic aggregate located inside the fabric sleeve; and a bottom panel joined to the protective sleeve.

9. The sump basin protective sleeve of claim 8 further comprising cell pockets formed along the length and width of the fabric sleeve such that a portion of the geosynthetic aggregate is contained within each said cell pocket.

10. The sump basin protective sleeve of claim 9 whereby the shape of the cell pockets can be hexagonal, square or circular in shape and said cell pockets can be adapted by a user to receive a drainage line.

11. The sump basin protective sleeve of claim 10 wherein the cell pockets are generally 4 inches wide.

12. The sump basin protective sleeve of claim 11 wherein there is at least one elastic vertical panel located on the protective sleeve.

13. The sump basin protective sleeve of claim 12 wherein the outer layer and the inner layer are both generally rectangular in shape and are joined to each other on three sides before the geosynthetic aggregate is introduced into the interior cavity and once the geosynthetic aggregate is introduced into the interior cavity the final side of the outer layer and inner layer are joined together.

14. The sump basin protective sleeve of claim 8 wherein the fabric is a polyester microfiber.

15. The sump basin protective sleeve of claim 8 wherein the geosynthetic aggregate is either recycled or non-recycled expanded polystyrene foam.

* * * * *